US007168657B2

(12) United States Patent
Chen

(10) Patent No.: US 7,168,657 B2
(45) Date of Patent: Jan. 30, 2007

(54) TOY HELICOPTER LANDING SKID STRUCTURE

(76) Inventor: Chien-chao Chen, No. 2-1, Sec 2, Lin yun Rd, Wu Gu Hsiang, Taipei 251 (TW)

( * ) Notice: Subject to any disclaimer, the term of this patent is extended or adjusted under 35 U.S.C. 154(b) by 0 days.

(21) Appl. No.: 11/431,853

(22) Filed: May 11, 2006

(65) Prior Publication Data

US 2006/0255209 A1 Nov. 16, 2006

(30) Foreign Application Priority Data

May 16, 2005 (TW) ..... 94207895 U

(51) Int. Cl.
*B64C 25/52* (2006.01)
*A63H 27/00* (2006.01)

(52) U.S. Cl. ..... 244/108; 446/34

(58) Field of Classification Search ..... 446/34, 446/35, 36; 244/108, 17.17
See application file for complete search history.

(56) References Cited

U.S. PATENT DOCUMENTS 1,806,807 A * 5/1931 Kunderd ..... 244/108
1,891,188 A * 12/1932 Stalb, Jr. ..... 244/108
1,892,064 A * 12/1932 Markey ..... 244/108
2,074,897 A * 3/1937 Everts ..... 244/46
2,411,596 A * 11/1946 Shapiro et al. ..... 446/232
2,469,144 A * 5/1949 Baggott ..... 446/232
D158,936 S * 6/1950 Crowder ..... D21/442
D169,558 S * 5/1953 Nagler ..... D21/442
2,641,423 A * 6/1953 Bassett et al. ..... 244/100 R
3,173,632 A * 3/1965 Woods ..... 244/100 R
3,716,208 A * 2/1973 Fagan et al. ..... 244/108
3,770,292 A * 11/1973 Seefluth ..... 244/154
3,800,896 A * 4/1974 Albertson ..... 280/25
3,854,541 A * 12/1974 Hollnagel ..... 280/26
4,196,878 A * 4/1980 Michel ..... 244/108
4,270,711 A * 6/1981 Cresap et al. ..... 244/17.17
4,519,559 A * 5/1985 Logan et al. ..... 244/17.17
4,604,075 A * 8/1986 Richards et al. ..... 446/232
4,645,143 A * 2/1987 Coffy ..... 244/100 R
4,728,311 A * 3/1988 Magers ..... 446/228
5,211,359 A * 5/1993 Rene et al. ..... 244/108
5,381,988 A * 1/1995 Kattas ..... 244/153 A
5,609,312 A * 3/1997 Arlton et al. ..... 244/17.11
6,142,419 A * 11/2000 Arlton ..... 244/100 R
6,183,331 B1 * 2/2001 Lai ..... 446/34
6,659,395 B2 * 12/2003 Rehkemper et al. ..... 244/17.11
6,715,714 B2 * 4/2004 Temple ..... 244/104 CS
6,755,716 B2 * 6/2004 Agostini et al. ..... 446/435
2004/0087241 A1 * 5/2004 Agostini et al. ..... 446/36

* cited by examiner

*Primary Examiner*—Yeri Pham Luu
*Assistant Examiner*—Edward J. Mayle

(57) ABSTRACT

A toy helicopter landing skid structure includes an upper support stand, a propping member and a bottom stand. The upper support stands are connected to the bottom of a helicopter airframe, and the propping member is connected to the bottom of each upper support stand, two insert slots extended in opposite directions at each connecting position of the upper support stand, the propping member and the bottom stand, a hollow portion disposed in each insert slot for clamping an elastic member, a plurality of fixing holes disposed at the bottom of each propping member, a plurality of bottom stands disposed at each propping member for passing a binder through the two fixing holes for binding the propping member with the bottom stand, so as to absorb external forces and impact by the slanting connected upper support stand with the insert slot and the installed elastic member.

4 Claims, 6 Drawing Sheets

TOY HELICOPTER LANDING SKID STRUCTURE

FIELD OF THE INVENTION

The present invention relates to an improved toy helicopter landing skid structure, and more particularly to a landing skid featuring a simple structure, a low cost, and a good shock absorbing effect.

BACKGROUND OF THE INVENTION

Referring to FIG. 1 for a traditional toy helicopter landing skid structure, a helicopter airframe 40 includes a plurality of support stands extended downward from both sides of the helicopter airframe 40, and two bottom stands 6 longitudinally and parallelly coupled to the bottom of the plurality of support stands 5 for touching the ground to give a secured support. Since the foregoing structure does not come with any shock absorbing device, a large shock and vibration will be produced easily when the toy helicopter is flying or landing, and thus not only the support stand 5 and the bottom stands 6 have to bear a very large impact, but the electronic or mechanical components in the helicopter airframe 40 also receive an excessively large impact that may result in their failure and damage.

Further, the foregoing traditional toy helicopter landing skid structure seems to have a simple structure, but its installation is actually laborious and requires other tools for the installation, disassembly, and maintenance.

In view of the foregoing shortcomings of the traditional toy helicopter landing skid structure, the inventor of the present invention conducted extensive researches and experiments, and invented the present invention to overcome the shortcomings of the prior art.

SUMMARY OF THE INVENTION

Therefore, it is a primary objective of the present invention to provide an improved toy helicopter landing skid structure that comprises a plurality of upper support stands, two propping members and two bottom stands, wherein the plurality of upper support stands include a plurality of upper insert slots disposed at the middle section of the upper support stands and inserted into a lower insert slot disposed at the bottom of the helicopter airframe, and each insert slot includes a hollow portion disposed at an end for containing and clamping an elastic member, so that each upper support stand transversally connects the bottom of the helicopter airframe, and a lateral insert slot disposed inwardly and slantingly from the bottom of both ends of each upper support stand, and a lateral hollow portion disposed in a distal end of each lateral insert slot for containing an elastic member, and a plurality of insert slots disposed on a side of the two propping member and inserted into a lateral insert slot for each upper support stand, and a hollow portion is disposed in a distal end of the insert slot corresponding to a lateral hollow portion of the upper support stand for clamping the elastic member, and a plurality of fixing holes disposed on another side of the propping member, and two bottom stands include a plurality of fixing holes disposed at the middle section corresponding to the fixing hole of the propping member for passing a binder through the two fixing holes for a binding, so as to connect the propping member with the bottom stand. The foregoing structural design with a slanting connection between each insert slot and each elastic member can effectively absorb the shocks and prevent a distortion or a deformation produced by external forces, so as to prevent various different electronic or mechanical components in the helicopter airframe from being broken down or damaged due to vibration.

Another objective of the present invention is to provide an improved toy helicopter landing skid structure, such that the related insert slots are inserted, and each elastic member can be clamped at the periphery of each hollow portion manually, and thus no tool is required for the installation.

The detail structure, applied principles, effects and performance of the present invention will become apparent in the following detailed description taken with the accompanying drawings.

DETAILED DESCRIPTION OF THE PREFERRED EMBODIMENTS

To make it easier for our examiner to understand the objective, features, and performance of the present invention, we use a preferred embodiment together with the attached drawings for the detailed description of the invention.

Figure 1:
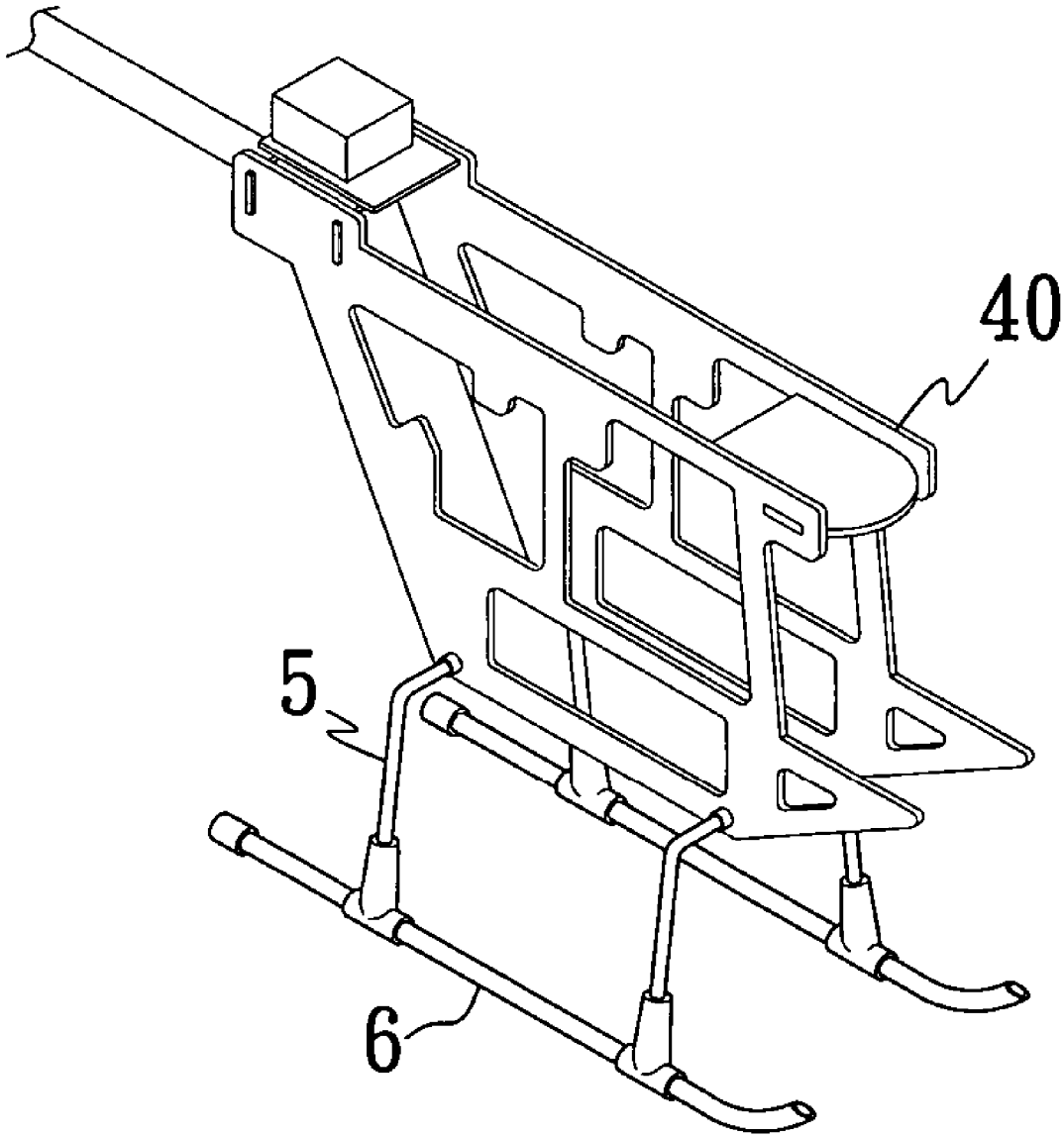
(PRIOR ART) Fig. 1
FIG. 1 is a schematic view of the structure of a traditional helicopter landing skid.

Referring to FIG. 1 for the traditional toy helicopter landing skid structure, its components and shortcomings have been described previously, and thus will not described here.

Figure 2:
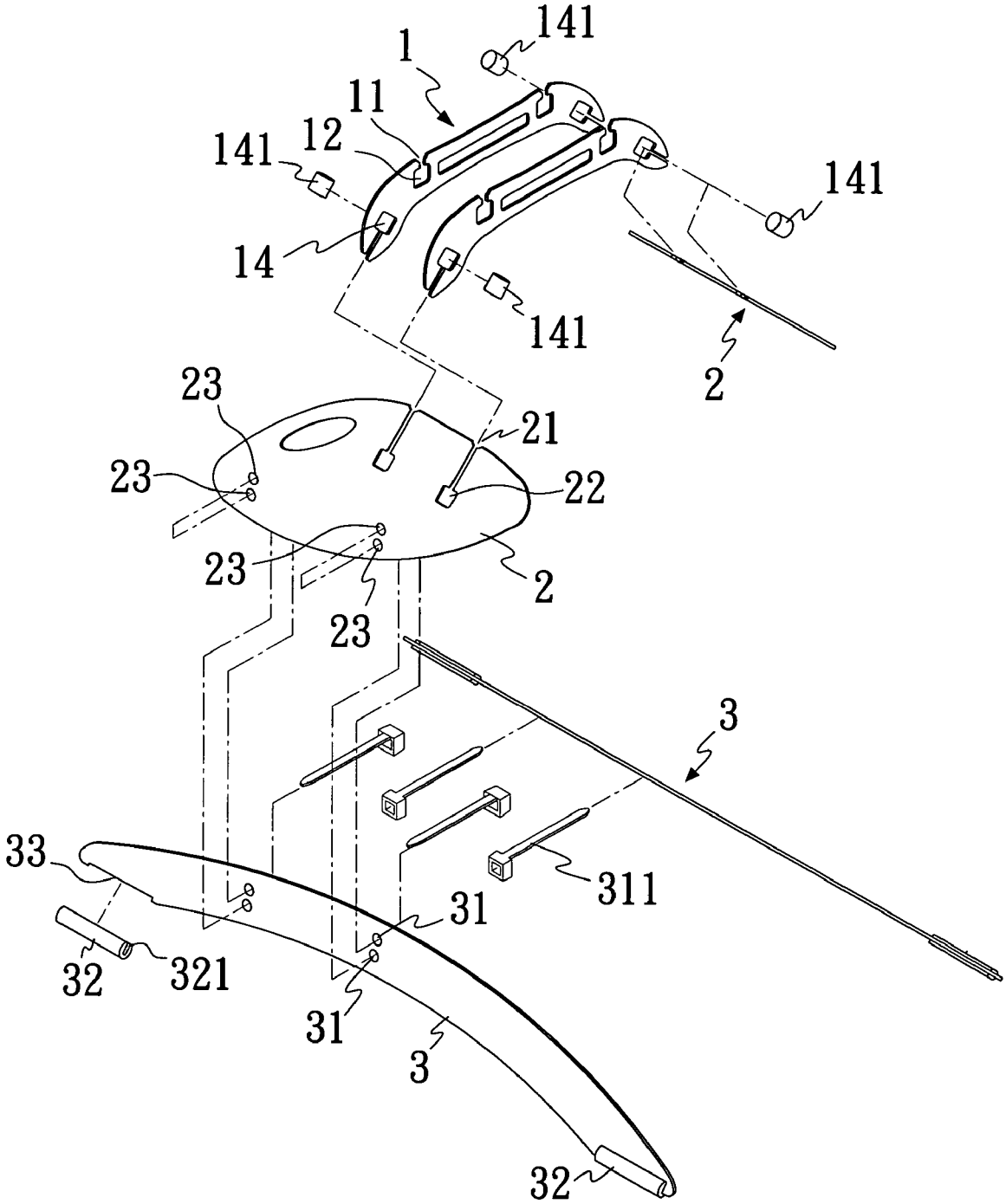
FIG. 2 is an exploded view of a structure of the present invention.
Figure 3:
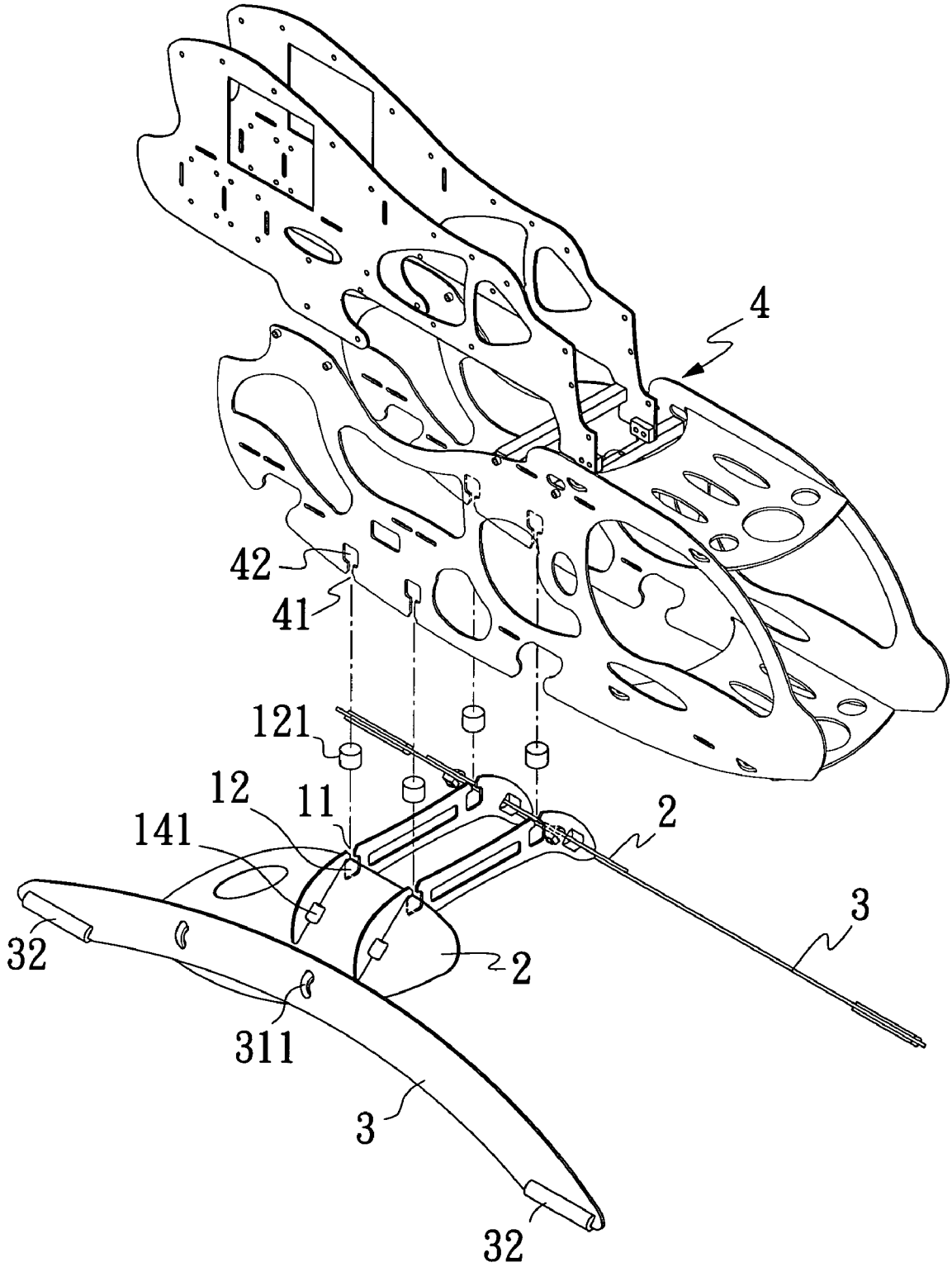
FIG. 3 is a schematic view of a partial structure of the present invention.
Figure 4:
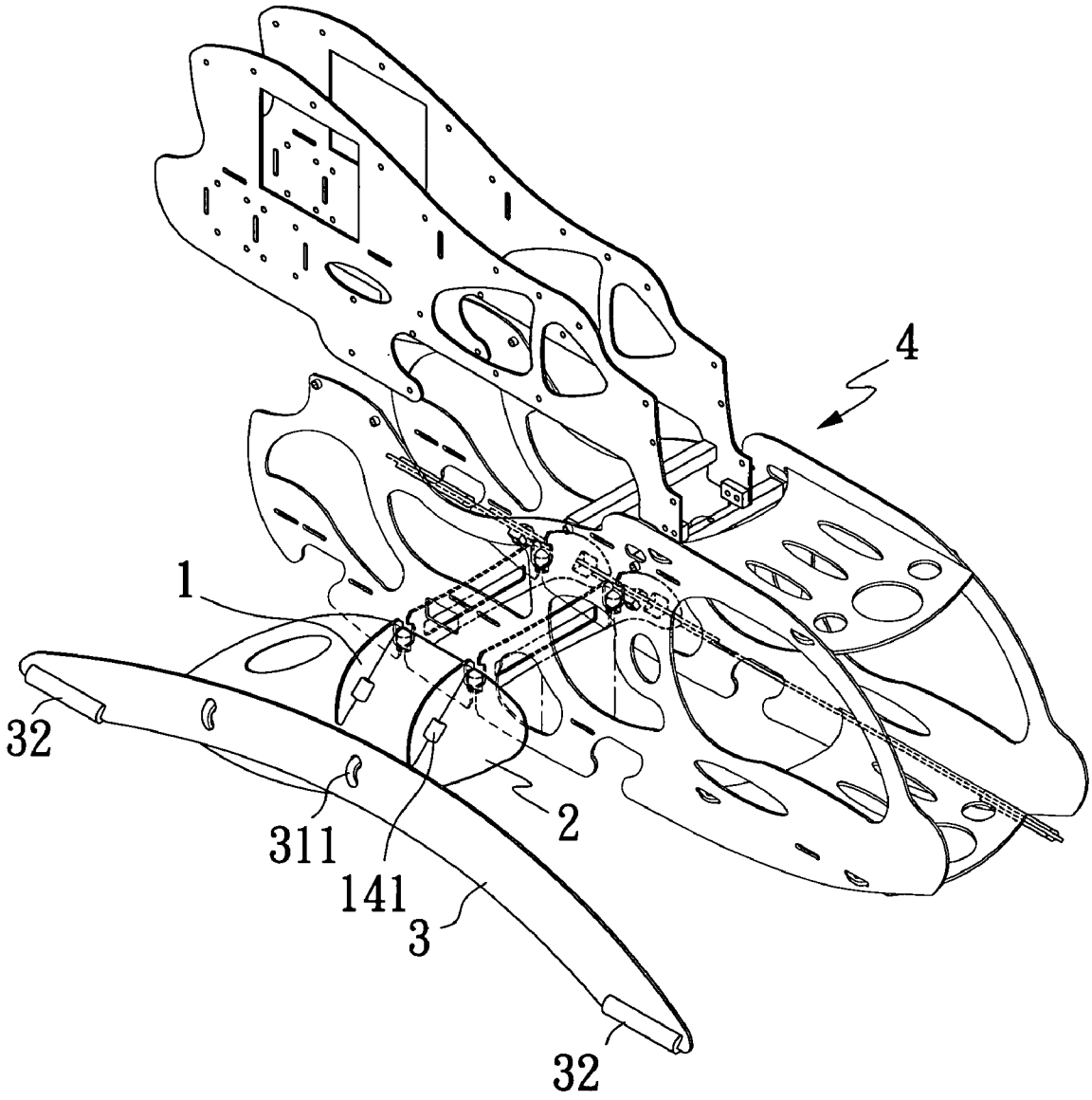
FIG. 4 is a schematic view of an overall assembly of the present invention.

Referring to FIG. 2 for the exploded view of the present invention, FIG. 3 for the schematic view of a partial structure of the present invention and FIG. 4 for the schematic view of the overall structure of the present invention, the invention comprises a plurality of upper support stands 1, two propping members 2 and two bottom stands 3, wherein the upper support stand 1 includes a plurality of upper insert slots 11 disposed at the middle section of the upper support stand 1 and inserted into corresponding lower insert slots 41 disposed at the bottom of the helicopter airframe 40, and an upper hollow portion 12 is disposed in a distal end of the upper insert slots 11 for containing an elastic member 121, and a lower hollow portion 42 is disposed in a distal end of the lower insert slot 41 and corresponding to the upper hollow portion 12 for containing and clamping the elastic member 121, such that each upper support stand 1 can be connected transversally and parallelly with the bottom of the helicopter airframe 4. Further, each bottom of two distal ends of the upper support stand 1 includes an upwardly slanting lateral insert slot 13, and each lateral insert slot 13 includes a lateral hollow portion 14 disposed in a distal end of the lateral insert slot 13 for containing an elastic member 141, and a side of the two propping members 2 includes a plurality of insert slots 21 to be inserted into the lateral insert slot 13 of each upper support stand 1, so that the two propping members 2 are connected to both ends of each upper support stand 1 and extended slantingly downward. The distal end of the insert slot 21 includes a hollow portion corresponding to the lateral hollow portion 14 of the upper support stand 1 for clamping the elastic member 141, and another side of the propping member 2 includes a plurality of fixing holes 23, two bottom stands 3 being curvedly and upwardly extended from a middle section of the bottom stand 3 and having a plurality of fixing holes 31 disposed at the middle section of the bottom stand 3 and corresponding to the fixing holes 23 of the propping member 2 for passing a binder 311 through the two fixing holes for a binding, such that the propping member 2 is connected to the bottom stands 3, and the bottom of each distal end of the bottom stands 3 includes an indent 33 for inserting a shock absorber 32 into a prepared insert crevice 321 for the connection and fixing.

Figure 5:
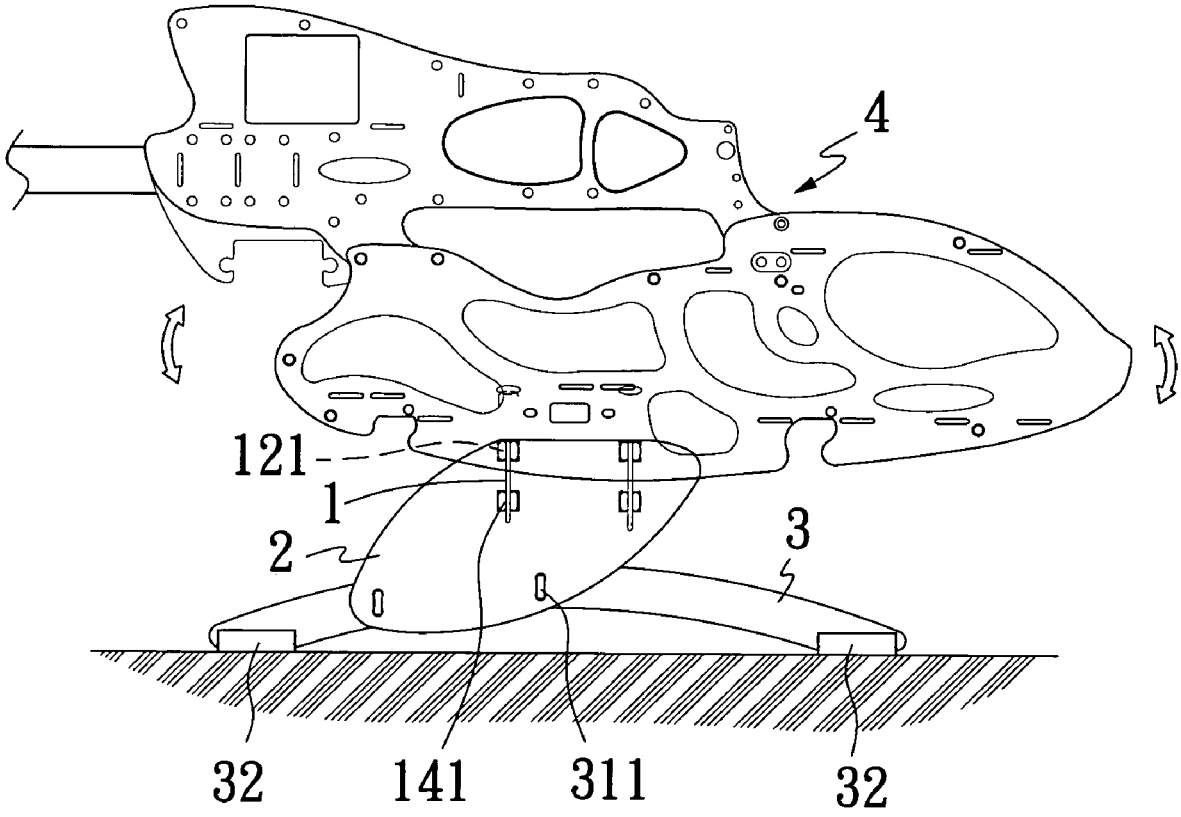
FIG. 5 is a side view of a structure of a landing skid combined with a helicopter airframe according to the present invention.
Figure 6:
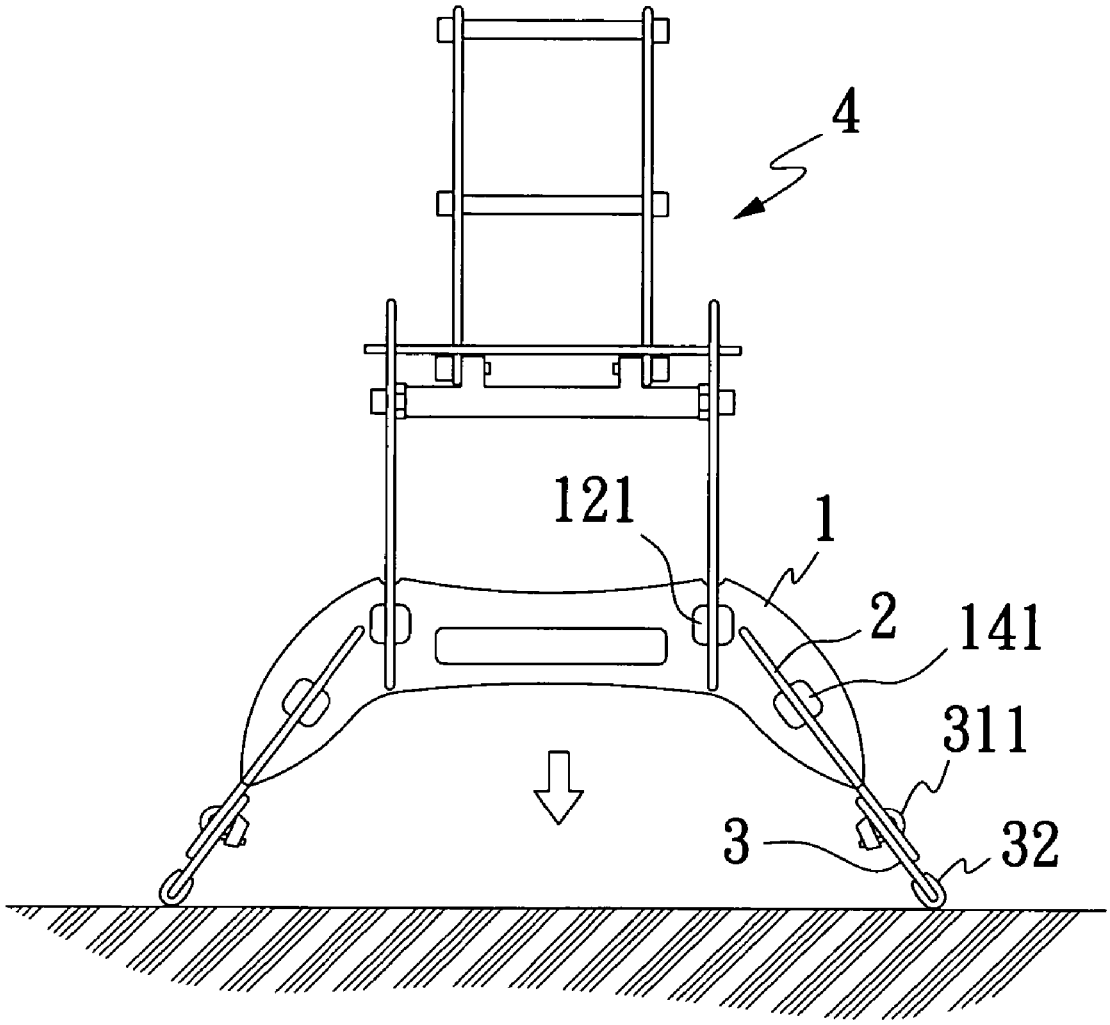
FIG. 6 is a front view of a structure of a landing skid combined with a helicopter airframe according to the present invention.

Referring to FIG. 5 for the side view of a structure of a landing skid combined with a helicopter airframe according to the present invention and FIG. 6 for the front view of a structure of a landing skid combined with a helicopter airframe according to the present invention, the helicopter airframe 4 produces a downward action (or impact) when the toy helicopter is flying or landing. By then, the mutually connected upper insert slots 11 and lower insert slot 41 can effectively absorb the shocks that may cause a distortion or a deformation to the upper support stand 1 and the helicopter airframe 4 in a sideway or back-and-forth direction. With the elastic member 141 that absorbs the impacts along the vertical direction, the mutually connected lateral insert slot 13 and insert slot 21 can effectively absorb the shocks that may cause a distortion or a deformation to the upper support stand 1 and the propping member 2. With the upper support stand 141 that absorbs the shocks along the horizontal direction, the collision and vibration of the helicopter airframe 4 can be lowered to prevent various different electronic or mechanical components from being broken down or damaged due to shocks.

In summation of the description above, the improved toy helicopter landing skid structure of the present invention herein enhances the performance over the conventional structure by providing a very good shock absorbing effect and complies with the patent application requirements.

What is claimed is:

1. An improved toy helicopter landing skid structure, comprising:

a plurality of upper support stands, transversally and parallelly coupled to the bottom of a helicopter airframe and having an inwardly and upwardly slanting lateral insert slot disposed separately disposed at the bottom of both distal ends of said each upper support stand, and a lateral hollow portion disposed in a distal end of said each lateral insert slot for containing an elastic member;

two propping members, having a plurality of insert slots disposed at a side of said each propping member and inserted into a lateral insert slot of said each upper support stand, and a hollow portion disposed in a distal end of said insert slot and corresponding to said lateral hollow portion of said upper support stand for clamping said elastic member, and a plurality fixing holes disposed on another side of said propping member;

two bottom stands, having a plurality of fixing holes disposed at the middle section of said each bottom stand and corresponding to said fixing hole of said propping member for passing a binder through said two fixing holes and binding said propping member and said bottom stand;

thereby, the slanting connection of said upper support stand and said propping member into said insert slot and said elastic member can effectively absorbs shocks and prevent a distortion or a deformation caused by an external force.

2. The improved toy helicopter landing skid structure of claim 1 further comprising an insert slot separately disposed at the bottom of said helicopter airframe and the top of said each upper support stand, and an upper hollow portion disposed in a distal end of said each insert slot for clamping an elastic member, such that the installation of said elastic member can improve the overall capability of absorbing shocks.

3. The improved toy helicopter landing skid structure of claim 1, wherein said bottom stand is curvedly and upwardly extended from a middle section of said bottom stand and an indent is disposed at the bottom of said bottom stand for inserting and fixing a shock absorber into a prepared insert crevice, such that said shock absorber can be used for improving the overall capability of absorbing shocks.

4. The improved toy helicopter landing skid structure of claim 2, wherein said bottom stand is curvedly and upwardly extended from a middle section of said bottom stand and an indent is disposed at the bottom of said bottom stand for inserting and fixing a shock absorber into a prepared insert crevice, such that said shock absorber can be used for improving the overall capability of absorbing shocks.

* * * * *